US007224319B2

(12) United States Patent
Kubba et al.

(10) Patent No.: US 7,224,319 B2
(45) Date of Patent: May 29, 2007

(54) MULTIPLE-ELEMENT BEAM STEERING ANTENNA

(75) Inventors: Sundus Kubba, Saline, MI (US); Wladimiro Villarroel, Worthington, OH (US)

(73) Assignee: AGC Automotive Americas R&D Inc., Ypsilanti, MI (US)

( * ) Notice: Subject to any disclaimer, the term of this patent is extended or adjusted under 35 U.S.C. 154(b) by 140 days.

(21) Appl. No.: 11/031,660

(22) Filed: Jan. 7, 2005

(65) Prior Publication Data

US 2006/0152422 A1 Jul. 13, 2006

(51) Int. Cl.
*H01Q 1/32* (2006.01)

(52) U.S. Cl. ..... 343/713; 343/700 MS; 343/725

(58) Field of Classification Search ..... 343/700 MS, 343/725, 729, 711, 713, 846
See application file for complete search history.

(56) References Cited

U.S. PATENT DOCUMENTS

| | | | | |
|---|---|---|---|---|
| 3,958,245 | A * | 5/1976 | Cherenko et al. | 343/713 |
| 5,287,116 | A | 2/1994 | Iwasaki et al. | |
| 5,317,327 | A | 5/1994 | Piole | |
| 5,760,744 | A | 6/1998 | Sauer | |
| 6,147,648 | A | 11/2000 | Granholm et al. | |
| 6,300,900 | B1 * | 10/2001 | Bleret et al. | 342/361 |
| 6,545,647 | B1 | 4/2003 | Sievenpiper et al. | |
| 6,633,258 | B2 | 10/2003 | Lindenmeier et al. | |
| 6,697,019 | B1 | 2/2004 | Hyuk-Joon et al. | |
| 6,768,457 | B2 | 7/2004 | Lindenmeier | |
| 6,879,294 | B2 * | 4/2005 | Yuanzhu | 343/725 |
| 6,954,183 | B2 * | 10/2005 | Solbach | 343/771 |
| 7,046,199 | B2 * | 5/2006 | Montgomery et al. | 343/700 MS |
| 2002/0083458 | A1 | 6/2002 | Henderson et al. | |
| 2002/0118138 | A1 | 8/2002 | Lindenmeier et al. | |
| 2002/0158808 | A1 | 10/2002 | Inoue | |
| 2002/0167449 | A1 | 11/2002 | Frazita | |
| 2003/0052834 | A1 | 3/2003 | Sievenpiper et al. | |
| 2003/0197651 | A1 | 10/2003 | Yuanzhu | |
| 2003/0218571 | A1 | 11/2003 | Yoon et al. | |
| 2004/0017327 | A1 | 1/2004 | Petropoulos | |
| 2004/0140940 | A1 | 7/2004 | Vothknecht et al. | |

FOREIGN PATENT DOCUMENTS

| | | | |
|---|---|---|---|
| EP | 0 124 047 | A2 | 7/1984 |
| WO | 2004/095639 | A1 | 11/2004 |

OTHER PUBLICATIONS

European Search Report and European Search Opinion, Nov. 28, 2006, European Patent Office.

* cited by examiner

*Primary Examiner*—Hoanganh Le
(74) *Attorney, Agent, or Firm*—Howard & Howard Attorneys, P.C.

(57) ABSTRACT

An antenna for receiving and/or transmitting circularly and linearly polarized RF signals includes a circularly polarized radiation element and a linearly polarized radiation element. The radiation elements are disposed co-planar and spaced apart from each other on a pane of glass. The linearly polarized radiation element is fed with a phase-shifted signal line. A ground plane is disposed parallel to the radiation elements to sandwich a dielectric of air. The antenna produces the effect of tilting a radiation beam from a higher to a lower elevation angle to achieve a higher gain at lower elevation angles.

35 Claims, 7 Drawing Sheets

MULTIPLE-ELEMENT BEAM STEERING ANTENNA

BACKGROUND OF THE INVENTION

1. Field of the Invention

The subject invention relates to an antenna, specifically a multi-element antenna in an array-type configuration, for receiving a circularly polarized radio frequency (RF) signal from a satellite and a linearly polarized RF signal from a terrestrial source.

2. Description of the Prior Art

Vehicles have long implemented glass to enclose a cabin of the vehicle while still allowing visibility for the driver of the vehicle. Automotive glass is typically either a tempered (or toughened) glass or a laminated glass which is produced by bonding two or more panes of glass together with a plastic interlayer. The interlayer keeps the panes of glass together even when the glass is broken.

Recently, antennas have been integrated with the glass of the vehicle. This integration helps improve the aerodynamic performance of the vehicle as well to help provide the vehicle with an aesthetically-pleasing, streamlined appearance. Integration of antennas for receiving linearly polarized RF signals, such as those generated by AM/FM terrestrial broadcast stations, has been the principal focus of the industry.

However, that focus is shifting to integrating antennas for receiving RF signals from Satellite Digital Audio Radio Service (SDARS) providers. SDARS providers use satellites to broadcast RF signals, particularly circularly polarized RF signals, back to Earth. SDARS providers use multiple satellites in a geostationary orbit or in an inclined elliptical constellation. The elevation angle between the respective satellite and the antenna is variable depending on the location of the satellite and the location of the antenna. Within the continental United States, this elevation angle may be as low as 20°. Accordingly, specifications of the SDARS providers require a relatively high gain at elevation angles as low as 20°. SDARS providers also use terrestrial "repeater" stations to rebroadcast their satellite signal. These terrestrial stations operate at an elevation angle of 0° and are useful in urban environments where tall buildings may obstruct signals from the satellites. Linear polarization is used for these terrestrial rebroadcasts.

Additionally, automotive manufacturers and vehicle drivers demand that the antenna integrated with the glass does not obstruct the view of the driver. Therefore, it is typically a requirement that the antenna occupy less than a certain surface area, or "footprint", when integrated with the glass.

Various antennas for receiving both circularly polarized and linearly polarized RF signals are known in the art. Examples of such antennas are disclosed in the U.S. Pat. No. 6,697,019 (the '019 patent) to Hyuk-Joon et al and U.S. Pat. No. 6,545,647 (the '647 patent) to Sievenpiper et al. The '019 patent discloses an antenna system installable on the roof of a vehicle for receiving RF signals produced by circularly polarized transmitters and linearly polarized transmitters. The antenna includes four linear polarized radiation elements and four circularly polarized radiation elements arranged symmetrically about a center. The antenna includes a circuit board for supporting the linear polarized radiation elements and a dielectric substrate. The linear polarized radiation elements each have a brick shape and include a microstrip resonator having a length of one-quarter wavelength λ. The circularly polarized radiation elements are microstrip patches disposed on the dielectric substrate. The circularly polarized radiation elements each have a square shape that is geometrically different from that of the linearly polarized radiation elements. The antenna system also includes a 90-degree hybrid. The 90-degree hybrid shifts the signal to two of the circularly polarized radiation elements by 90 degrees while the signal to the other two circularly polarized radiation elements is unshifted. The antenna requires separate feed lines for the linear and circular polarized signals.

Since the antenna of the '019 patent is a large, bulky array of antenna elements for mounting on the roof of the vehicle, it is not suitable for integration with a window of the vehicle. If the antenna of the '019 patent were to be mounted onto the window, the eight separate elements would occupy a large surface area and obstruct the view of a driver of the vehicle. Furthermore, the antenna does not significantly aid in reception of RF signals from low elevation angles.

The '647 patent discloses an antenna for receiving RF signals produced by circularly polarized transmitters and linearly polarized transmitters. The antenna includes four radiation elements arranged symmetrically about a center and disposed on a high impedance surface. The high impedance surface acts as a ground plane and is typically mounted on a large metallic object, such as a roof of a vehicle. The radiation elements are formed of an electrically conductive material and implemented either as pieces of wire or metallic patches. Various connections of phase-shift circuits to the radiation elements give the antenna its circular and linear polarizations. The antenna requires separate feed lines for a receiver to receive the linear and circular polarized signals. The antenna of the '647 patent does not significantly aid in reception of RF signals from low elevation angles.

There remains an opportunity to introduce an antenna that aids in the reception of the RF signal from a satellite. Particularly, there remains an opportunity for an antenna that aids in reception of the RF signal from elevation angles as low as 20°. Furthermore, there remains an opportunity for an antenna that does not significantly obstruct the view of the driver of the vehicle and provides both circular and linear polarized signals on a single feed line.

SUMMARY OF THE INVENTION AND ADVANTAGES

The subject invention provides a window having an integrated antenna. The window includes a nonconductive pane. A circularly polarized radiation element is disposed on the nonconductive pane. A linearly polarized radiation element is also disposed on the nonconductive pane and spaced from the circularly polarized radiation element. The linearly polarized radiation element has a geometric shape different from that of the circularly polarized radiation element.

The structure of the antenna produces a directional radiation beam with a highest gain portion at a certain elevation angle. The spacing between the radiation elements affects a relative phasing between the two different radiation elements. As a result of this relative phasing, the elevation angle of the radiation beam tilts; thus also tilting the highest gain portion of the radiation beam. This tilt is particularly important when receiving an RF signal broadcast from a satellite of a Satellite Digital Audio Radio Service (SDARS) provider. Specifications of the SDARS providers require a relatively high gain at elevation angles as low as 20°. The antenna of the subject invention produces a relatively high gain of the RF signal even at these low elevation angles.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
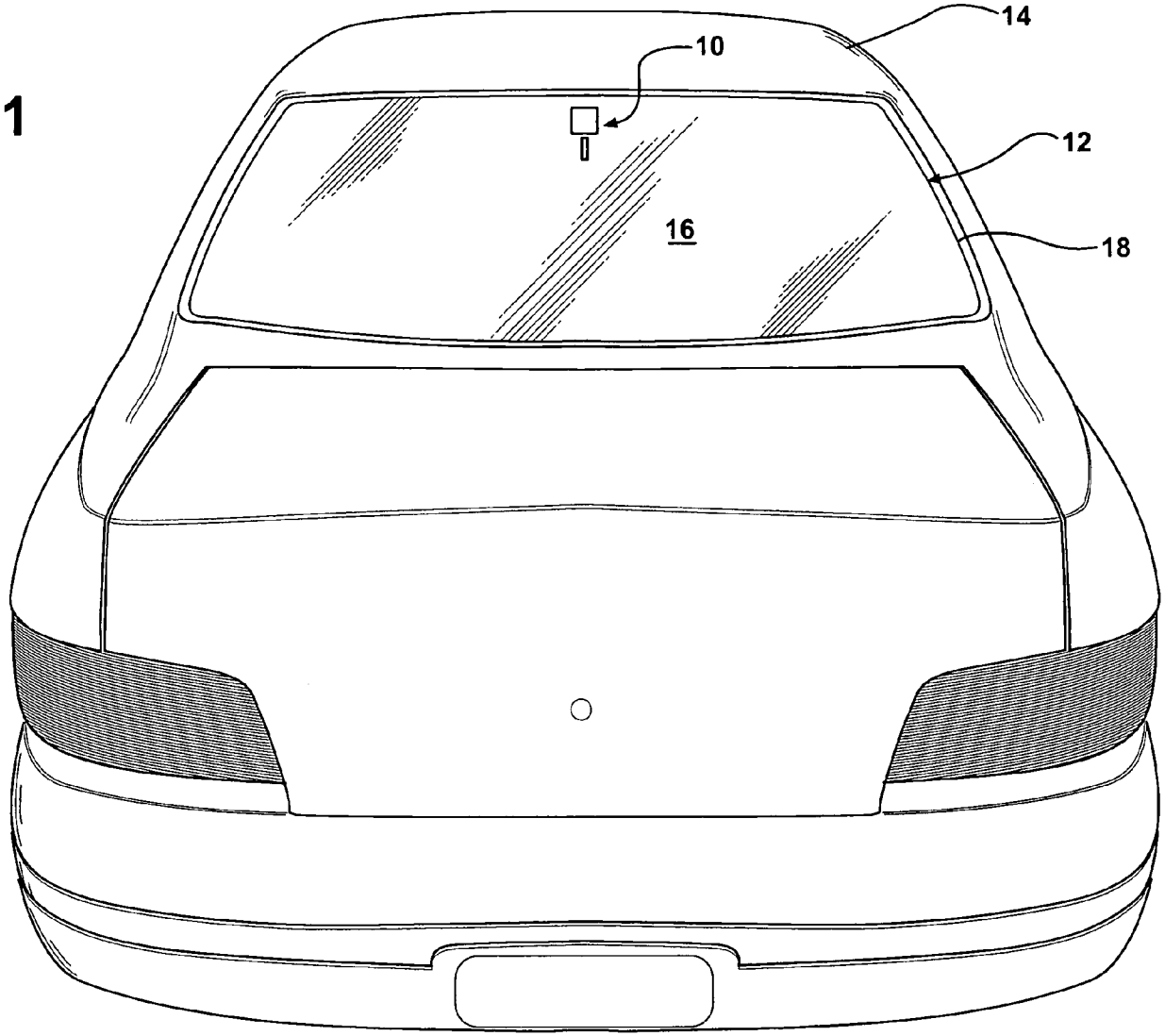
FIG. 1 is a perspective view of a vehicle with an antenna supported by a pane of glass of the vehicle.

Referring to the Figures, wherein like numerals indicate like parts throughout the several views, an antenna is shown generally at 10. The antenna 10 is utilized to receive a circularly polarized radio frequency (RF) signal from a satellite and a linearly polarized RF signal from a terrestrial source. Specifically, the first embodiment of the antenna 10 receives a left-hand circularly polarized (LHCP) RF signal like those produced by a Satellite Digital Audio Radio Service (SDARS) provider, such as XM® Satellite Radio or SIRIUS® Satellite Radio, and their associated linearly polarized terrestrial repeater broadcasts. However, it is to be understood that the antenna 10 may also receive a right-hand circularly polarized (RHCP) RF signal. Also, the antenna 10 may also be configured to receive linearly polarized RF signals that are either vertically or horizontally orientated. XM® Satellite Radio produces a vertically orientated linearly polarized signal. Furthermore, those skilled in the art realize that the antenna 10 may also be used to transmit the circularly and linearly polarized RF signals Referring to FIG. 1, the antenna 10 is preferably integrated with a window 12 of a vehicle 14. This window 12 may be a rear window 12 (backlite), a front window 12 (windshield), or any other window 12 of the vehicle 14. The antenna 10 may also be implemented in non-window portions of the vehicle, such as a roof or mirror. Furthermore, the antenna 10 may be implemented in other situations completely separate from the vehicle 14, such as on a building or integrated with a radio receiver. The window 12 includes at least one nonconductive pane 16. The term "nonconductive" refers to a material, such as an insulator or dielectric, that when placed between conductors at different potentials, permits only a small or negligible current in phase with the applied voltage to flow through material. Typically, nonconductive materials have conductivities on the order of nanosiemens/meter.

In the first embodiment, the nonconductive pane 16 is implemented as at least one pane of glass 18. Of course, the window 12 may include more than one pane of glass 18. Those skilled in the art realize that automotive windows 12, particularly windshields, may include two panes of glass 18 sandwiching a layer of polyvinyl butyral (PVB).

The pane of glass 18 is preferably automotive glass 18 and more preferably soda-lime-silica glass 18. The pane of glass 18 defines a thickness between 1.5 and 5.0 mm, preferably 3.1 mm. The pane of glass 18 also has a relative permittivity between 5 and 9, preferably 7. Those skilled in the art, however, realize that the nonconductive pane 16 may be formed from plastic, fiberglass, or other suitable nonconductive materials.

For descriptive purposes only, the subject invention is referred to below only in the context of the most preferred nonconductive pane 16, which is the pane of automotive glass 18. This is not to be construed as limiting, since, as noted above, the antenna 10 can be implemented with nonconductive panes 16 other than panes of glass 18.

Figure 2:
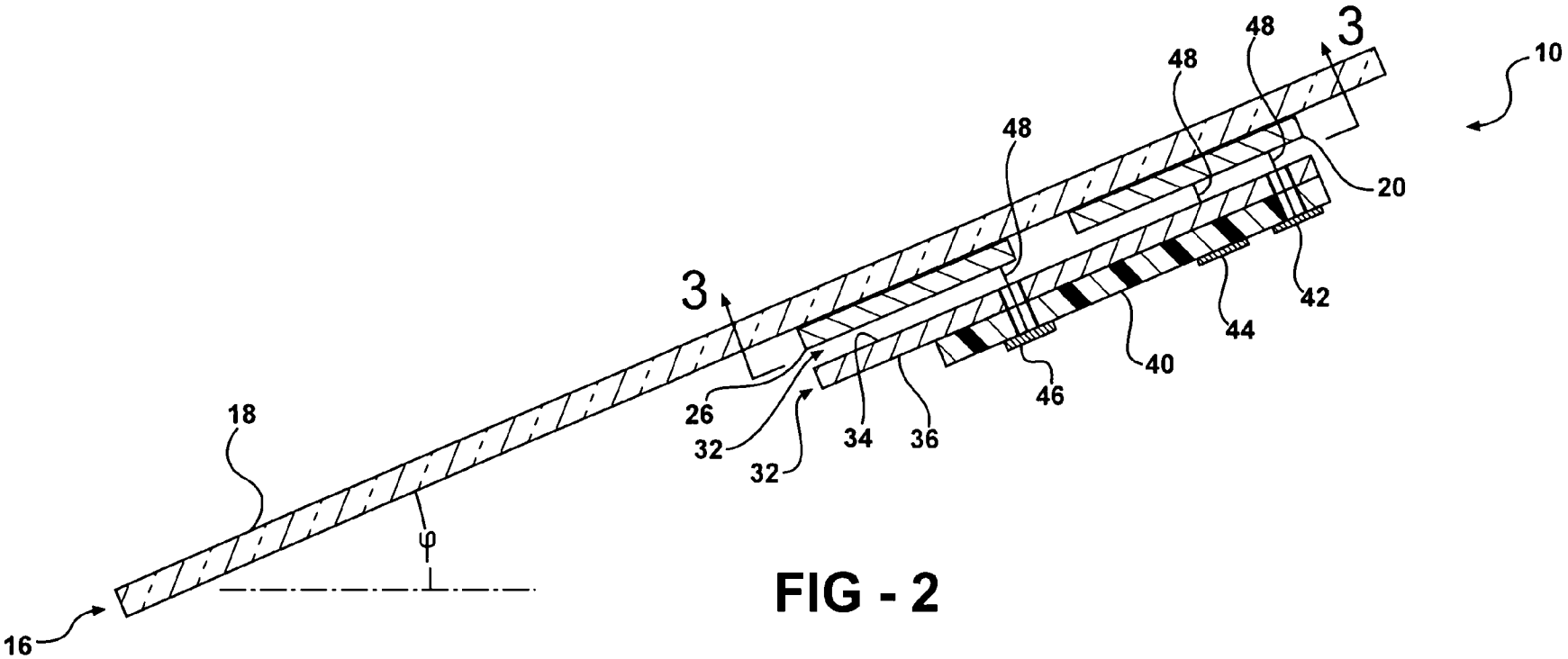
FIG. 2 is a cross sectional side view of a first embodiment of the antenna taken along line 2-2 of FIG. 3 showing the pane of glass, radiation elements, a ground plane, and a circuit board.

Referring now to FIG. 2, the pane of glass 18 functions as a radome to the antenna 10. That is, the pane of glass 18 protects the other components of the antenna 10, as described in detail below, from moisture, wind, dust, etc. that are present outside the vehicle 14. The pane of glass 18 is disposed at a mounting angle $\phi$ relative to the ground. Depending on the mounting angle $\phi$ required by the vehicle 12, it may be desirous to tilt the elevation angle of a radiation beam upwards or downwards to increase the gain of the RF signal transmitted by a satellite or terrestrial source and received by the antenna. The antenna 10, as explained more fully below, performs this beam tilting.

Figure 3:
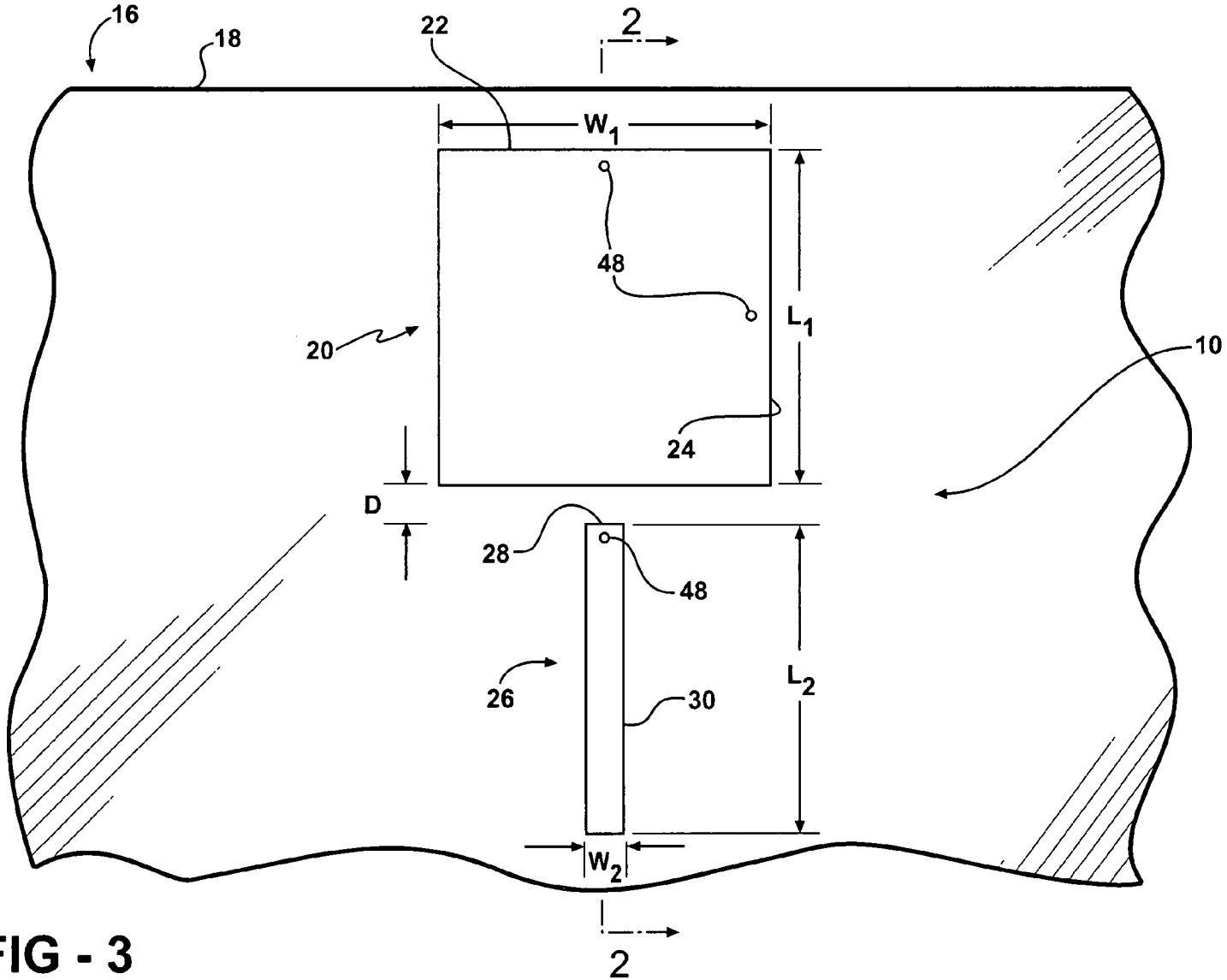
FIG. 3 is a cross-sectional bottom view of the first embodiment of the antenna taken along line 3-3 of FIG. 2 showing the radiation elements and the pane of glass.

Referring now to FIG. 3, the antenna 10 includes a circularly polarized radiation element 20 disposed on the pane of glass 18. The circularly polarized radiation element 20 preferably has a rectangular shape and most preferably has a square shape. The circularly polarized radiation element 20 preferably receives and/or transmits an RF signal having a circular polarization by using a 90° phase shift as described in detail below. The circularly polarized radiation element 20 is commonly referred to by those skilled in the art as a "patch" or a "patch element" and formed of an electrically conductive material. Preferably, the circularly polarized radiation element 20 comprises a silver paste as the electrically conductive material that is disposed directly on the pane of glass 18 and hardened by a firing technique known to those skilled in the art. Alternatively, the circularly polarized radiation element 20 could comprise a flat piece of conductive metal, such as copper or aluminum, adhered to the pane of glass 18 using an adhesive.

The circularly polarized radiation element 20 has a first edge 22 and a second edge 24, with the second edge 24 perpendicular to the first edge 22. The first edge 22 defines a first width $W_1$ and the second edge 24 defines a first length $L_1$. In the first embodiment, the first width $W_1$ and the first length $L_1$ of the circularly polarized radiation element 20 each measure about ½ of a wavelength $\lambda$ of a base signal to be received or transmitted by the antenna 10. Since the first width $W_1$ and the first length $L_1$ are preferably equal in length, the circularly polarized radiation element 20 preferably has a square shape. In the first embodiment, the desired frequency to be received is about 2,338 MHz, which corresponds to the center frequency used by XM® Satellite Radio. Therefore, in the first embodiment, the first and second edges 22, 24 of the circularly polarized radiation element 20 each measure about 64 mm.

The antenna 10 also includes a linearly polarized radiation element 26 formed of an electrically conductive material and disposed on the nonconductive pane 16. The linearly polarized radiation element 26 receives and/or transmits an RF signal having a linear polarization. The linearly polarized radiation element 26 may be implemented as a monopole by utilizing a segment of wire, a line of silver paste, or a rectangular-shaped section of electrically conductive material. Alternatively, the linearly polarized radiation element 26 may be implemented as a portion of electrically conductive material defining a slot.

The geometric shape of the linearly polarized radiation element 26 is different from that of the circularly polarized radiation element 20. As mentioned above, the circularly polarized radiation element 20 is preferably square-shaped. Another square-shaped element in combination with such a circularly polarized radiation element 20 would be unacceptable to automotive manufacturers and drivers based on the resulting size of the antenna 10 and the obstruction of the view of the driver, as is understood by those skilled in the art. Thus, the linearly polarized radiation element 26 must be of a different geometric shape than the circularly polarized radiation element 20, as well as occupying a smaller surface area, to satisfy the needs of the automotive manufacturers and drivers.

In the first embodiment, and as shown in FIG. 3, the linearly polarized radiation element 26 comprises a silver paste as the electrically conductive material that is disposed directly on the pane of glass 18 and hardened by a firing technique known to those skilled in the art. The linearly polarized radiation element 26 preferably has a rectangular shape with a third edge 28 and a fourth edge 30. The third edge 28 is perpendicular to the fourth edge 30. The third edge 28 defines a second width $W_2$ and the fourth edge 30 defines a second length $L_2$. The second width $W_2$ measures about 1/20 of the wavelength $\lambda$ and the second length $L_2$ measures about 1/2 of the wavelength $\lambda$. Therefore, at the desired frequency of 2,338 MHz, the second width $W_2$ measures about 6 mm and the second length $L_2$ measures about 64 mm. The linearly polarized radiation element 26 is spaced from the circularly polarized radiation element 20 by a distance D. The distance D is preferably in a range of 1/20 to 1/2 of the wavelength $\lambda$. More preferably, and in the first embodiment, the distance D measures about 1/5 of the wavelength $\lambda$, which is about 26 mm at the desired frequency of 2,338 MHz.

The radiation elements 20, 26 are preferably co-planar with one another. That is, the radiation elements 20, 26 lie generally in a single plane defined by a surface of the nonconductive pane 16. Said another way, the radiation elements 20, 26 are not one on top of the other and are conformal with a surface of the pane of glass 18.

In the first embodiment, the third edge 28 of the linearly polarized radiation element 26 is generally parallel to the first edge 22 of the circularly polarized radiation element 20. In this alignment, the linearly polarized radiation element 26 produces a vertically-oriented linearly polarization. The radiation elements 20, 26 have a combined surface area of about 4,250 $mm^2$. Therefore, the antenna 10 will not create a significant obstruction to the view of the driver of the vehicle 12.

Referring again to FIG. 2, the antenna 10 preferably includes a ground plane 32 for enhancing the performance of the antenna 10. The ground plane 32 is formed of a generally flat electrically conductive material, such as a conductive metal like copper or aluminum. The ground plane 32 is spaced from and preferably parallel to the radiation elements 20, 26. The ground plane 32 preferably has a rectangular shape with a first side 34 and a second side 36. The first side 34 faces the radiation elements 20, 26. Those skilled in the art realized that other shapes of the ground plane 32 may be implemented. Furthermore, the antenna 10 may function without the ground plane 32 whatsoever.

A dielectric 38 is sandwiched between the first side 34 of the ground plane 32 and the radiation elements 20, 26. In the first embodiment, the dielectric 38 is air, which has a relative permittivity of 1. However, depending on the particularly performance characteristics of the antenna 10, the dielectric 38 may be formed of one or more alternate materials having an alternate relative permittivity. The thickness T of the dielectric can be up to 1/4 of the wavelength $\lambda$, which is about 32 mm at the frequency of 2,338 MHz.

The antenna 10 also preferably includes a circuit board 40. The circuit board 40 is connected to the second side 36 of the ground plane 42. This location of the circuit board 40 is for convenience of connection to the radiation elements 20, 26 of the antenna 10 and compactness of the entire antenna 10. Those skilled in the art realized that the circuit board 40 may be implemented at a location distant from the radiation elements 20, 26. Alternatively, the antenna 10 could be implemented without a circuit board 40 whatsoever.

Figure 4:
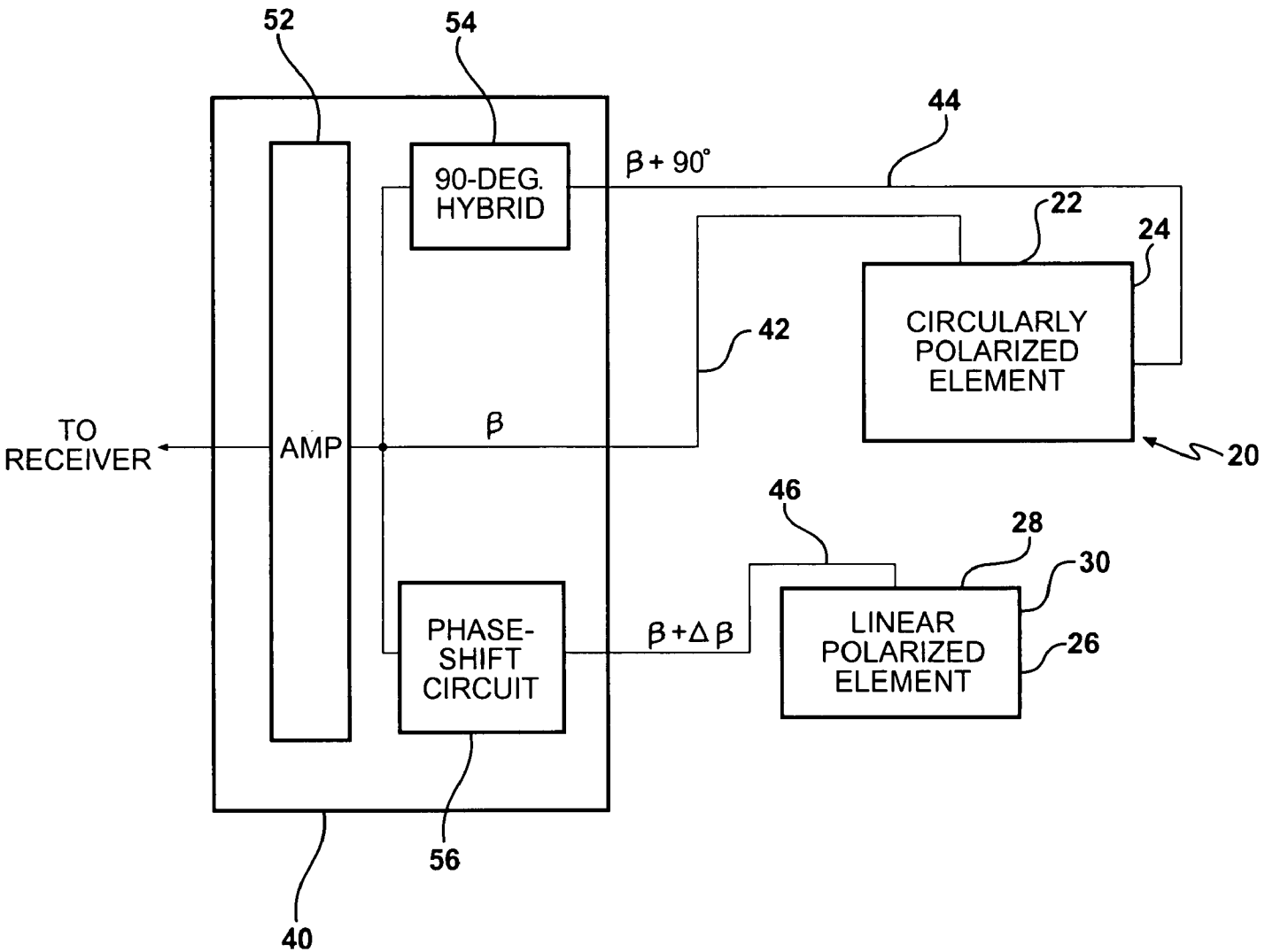
FIG. 4 is a schematic block diagram of the antenna showing electrical connections between the radiation elements, an amplifier, a 90 degree hybrid, and a phase shift circuit.

Referring now to FIG. 4, the antenna 10 also includes a base signal line 42, a 90°-shifted signal line 44, and a phase-shifted signal line 46. The base signal line 42 is electrically connected to the circularly polarized radiation element 20 adjacent the first edge 22 of the element 20, preferably near a center of the first edge 22. The 90°-shifted signal line 44 is electrically connected to the circularly polarized radiation element 20 adjacent the second edge 24, preferably near a center of the second edge 24. The base signal line 42 carries a base signal having a phase angle $\beta$. The 90°-shifted signal line 44 carries a signal shifted 90° from the base signal and therefore having a phase angle $\beta+90°$. Preferably, but not necessarily, the 90° shift is accomplished by a 90° hybrid 54, which is further described below.

The combination of the base signal and the 90°-shifted signal fed to perpendicular edges 22, 24 give the circularly polarized radiation element 20 a circular polarization. Those skilled in the art realize alternative techniques of generating circular polarization without use of a 90°-shifted signal line 44. These techniques, include, but are not limited to, a square-shaped radiation element with two opposite corners being truncated, a radiation element with a cross-shaped slot whose legs have unequal lengths, a radiation element with a 45° offset feed and trim tabs, a square-shaped radiation element with trim tabs. However, these techniques may or may not work effectively with the linearly polarized radiation element 26 to achieve the desired beam tilting, as described in more detail below.

The phase-shifted signal line 46 is electrically connected to the linearly polarized radiation element 26. Preferably, the phase-shifted signal line 46 is electrically connected adjacent the third edge 28, preferably near a center of the third edge 28. The phase-shifted signal line 46 carries a phase-shifted signal that is shifted from the base signal $\beta$ by a certain angle $\Delta\beta$. The phase angle of the phase-shifted signal is therefore $\beta+\Delta\beta$. Preferably, but not necessarily, the phase shift is accomplished by a phase shift circuit 56, which is further described below.

The circularly and linearly polarized radiation beams produced by the antenna 10 are tilted (or steered) by both the spacing, i.e., the distance D, between the radiation elements 20, 26 and the phase-shifted signal feeding the linearly polarized radiation element 26. The combination of these two techniques enhances the beam tilting effect. As mentioned previously, this tilt is particularly important when receiving an RF signal broadcast from a satellite of an SDARS provider. The magnitude of tilt is based on the relative phase angle $\gamma$ between the circularly polarized radiation element 20 and the linearly polarized radiation element 26. The relative phase angle $\gamma$, in turn, is determined by the both a certain angle $\Delta\beta$ of phase shift on the phase-shifted signal line 46 and the spacing distance D between the radiation elements 20, 26.

The signal lines 42, 44, 46 are each formed of an electrically conductive material. In the first embodiment, the signal lines 42, 44, 46 are implemented as microstrip lines disposed on the circuit board 40. A plurality of pins 48 electrically connects each of the signal lines 42, 44, 46 to their respective positions on the radiation elements 20, 26. The pins 48 are formed of an electrically conductive material, such as a conductive metal. The ground plane 32 and the circuit board 40 each define a plurality of holes 50. The holes 50 accommodate the pins 48 as they extend perpendicularly from the radiation elements 20, 26 to the signal lines 42, 44, 46 disposed on the circuit board 40. The pins 48 are preferably soldered to both the radiation elements 20, 26 and the signal lines 42, 44, 46. As such, the pins could also act to support the circuit board 40 and the ground plane 32. Alternatively, the overall packaging of the antenna 10 could also support the circuit board 40 and the ground plane 32. Of course, other alternative techniques of connecting the signal lines 42, 44, 46 to the radiation elements 20, 26 will be obvious to those skilled in the art. While direct electrical connection of the signal lines 42, 44, 46 to the radiation elements 20, 26 is preferred, the electrically connection may be accomplished by electromagnetically coupling the signal lines 42, 44, 46 to the radiation elements 20, 26.

Preferably, an amplifier 52 is electrically connected to the base signal line 42 for amplifying the base signal to generate an amplified signal. In configurations where the antenna 10 is implemented to receive RF signals, the amplifier 52 is a preferably a low-noise amplifier (LNA). The amplifier 52 is preferably disposed on the circuit board 40. A single feed line 53 is electrically connected to the amplifier 52 for carrying the amplified signal to a receiver. The amplified signal carried by the single feed line 53 provides a single source for RF signals received by the linearly and circularly polarized radiation elements 20, 26. Those skilled in the art realize that in configurations where the antenna 10 is used to transmit RF signals, the amplifier 52 would be implemented as a power amplifier.

The 90° hybrid 54 mentioned above is electrically connected between the base signal line 42 and the 90°-shifted signal line 50 for phase shifting the base signal by 90° to achieve the 90°-shifted signal. The 90° hybrid 54 is also preferably disposed on the circuit board 40.

The phase shift circuit 56 also mentioned above is electrically connected between the base signal line 42 and the phase-shifted signal line 36. The phase shift circuit 56 shifts the base signal by the certain angle $\Delta\beta$ to achieve the phase-shifted signal having the phase angle $\beta+\Delta\beta$. The phase shift circuit 56 is preferably disposed on the circuit board 40.

Figure 5:
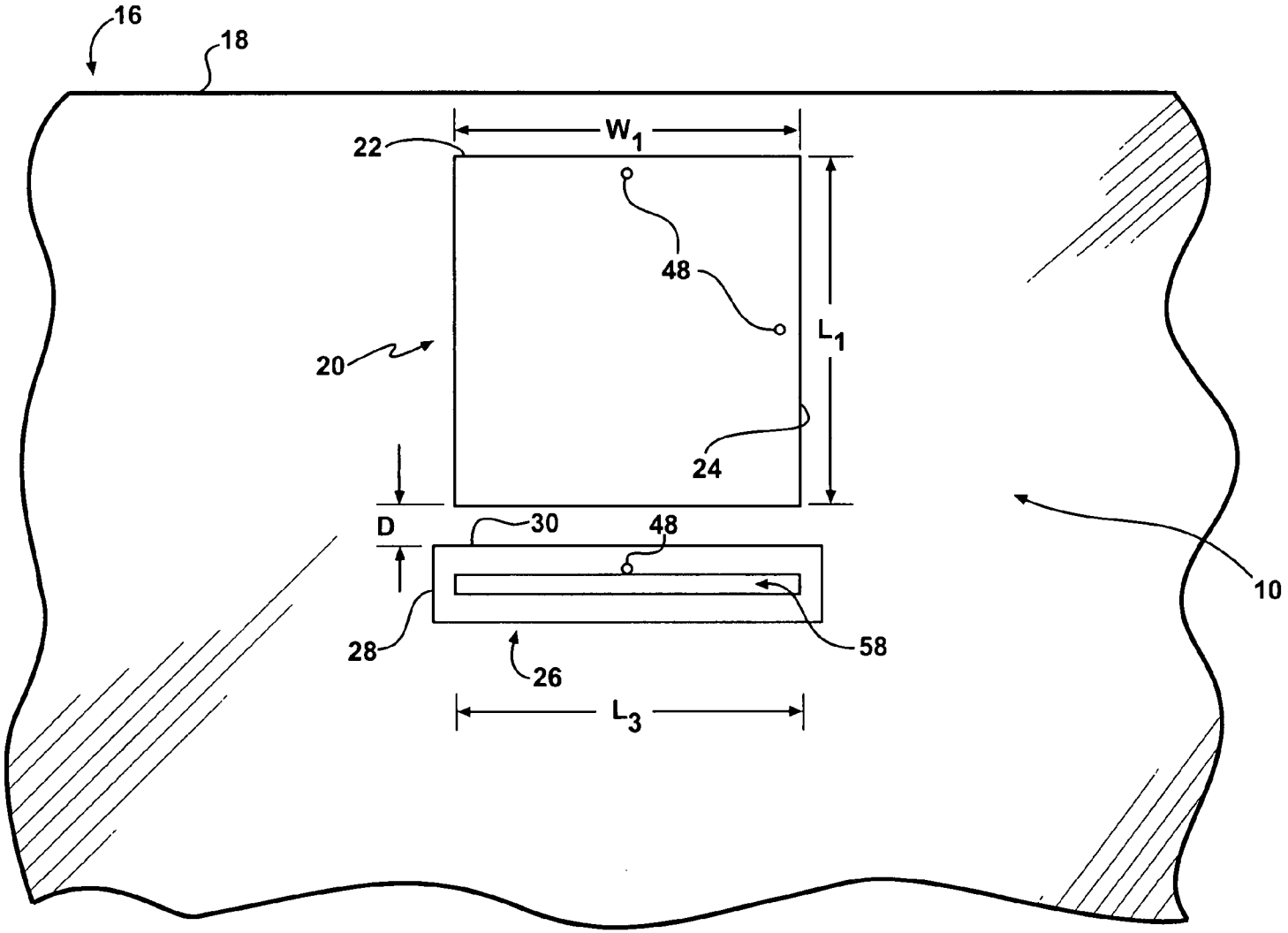
FIG. 5 is a cross-sectional bottom view of a second embodiment of the antenna showing the radiation elements and the pane of glass.

Other dimensions, alignments, and configurations of the radiation elements 20, 26 are possible, depending on the desired performance and dimensional area requirements of the antenna 10. In a second embodiment, as shown in FIG. 5, the dimensions of the circularly polarized radiation element 20 are the same as in the first embodiment. However, the linearly polarized radiation element 26 defines a slot 58. A length $L_3$ of the slot 58 is defined as ½ of the wavelength $\lambda$. The fourth edge 30 of the linearly polarized radiation element 26 is parallel to the first edge 22 of the circularly polarized radiation element 20. The electrical connection of the phase-shifted signal line 36 to the linearly polarized element is adjacent a center of the slot 58. The spacing distance D between the elements remains at the most preferred ⅕ of the wavelength $\lambda$.

Figure 6:
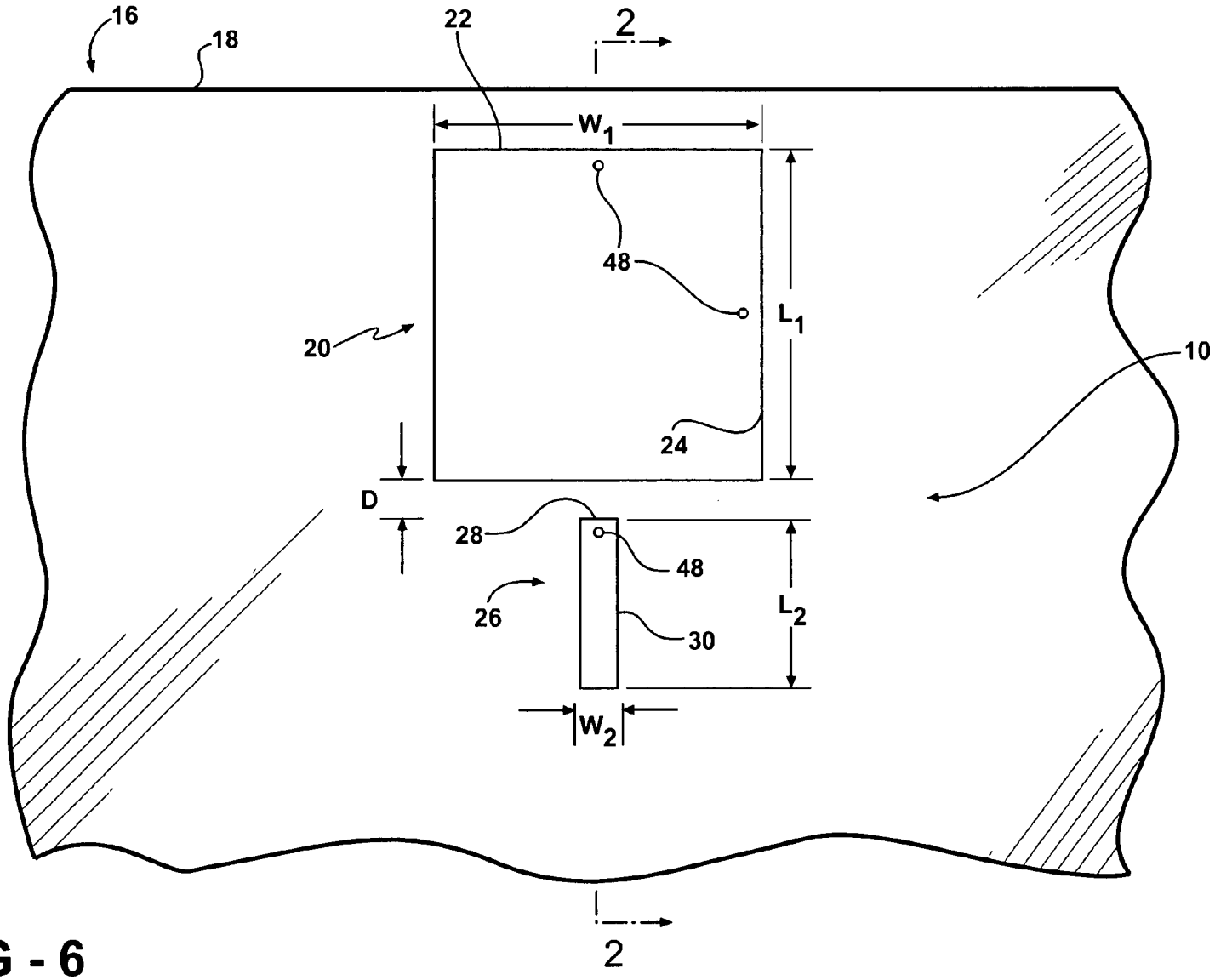
FIG. 6 is a cross-sectional bottom view of a third embodiment of the antenna showing the radiation elements and the pane of glass.

A third embodiment is shown in FIG. 6. This embodiment is similar to the first embodiment, except that the second length $L_2$ of the linearly polarized element 26 is ¼ of the wavelength $\lambda$. Again, the spacing distance D between the elements remains at the most preferred ⅕ of the wavelength $\lambda$. The third embodiment further reduces the surface area of the window 12 that is occupied by the antenna 10.

Figure 7:
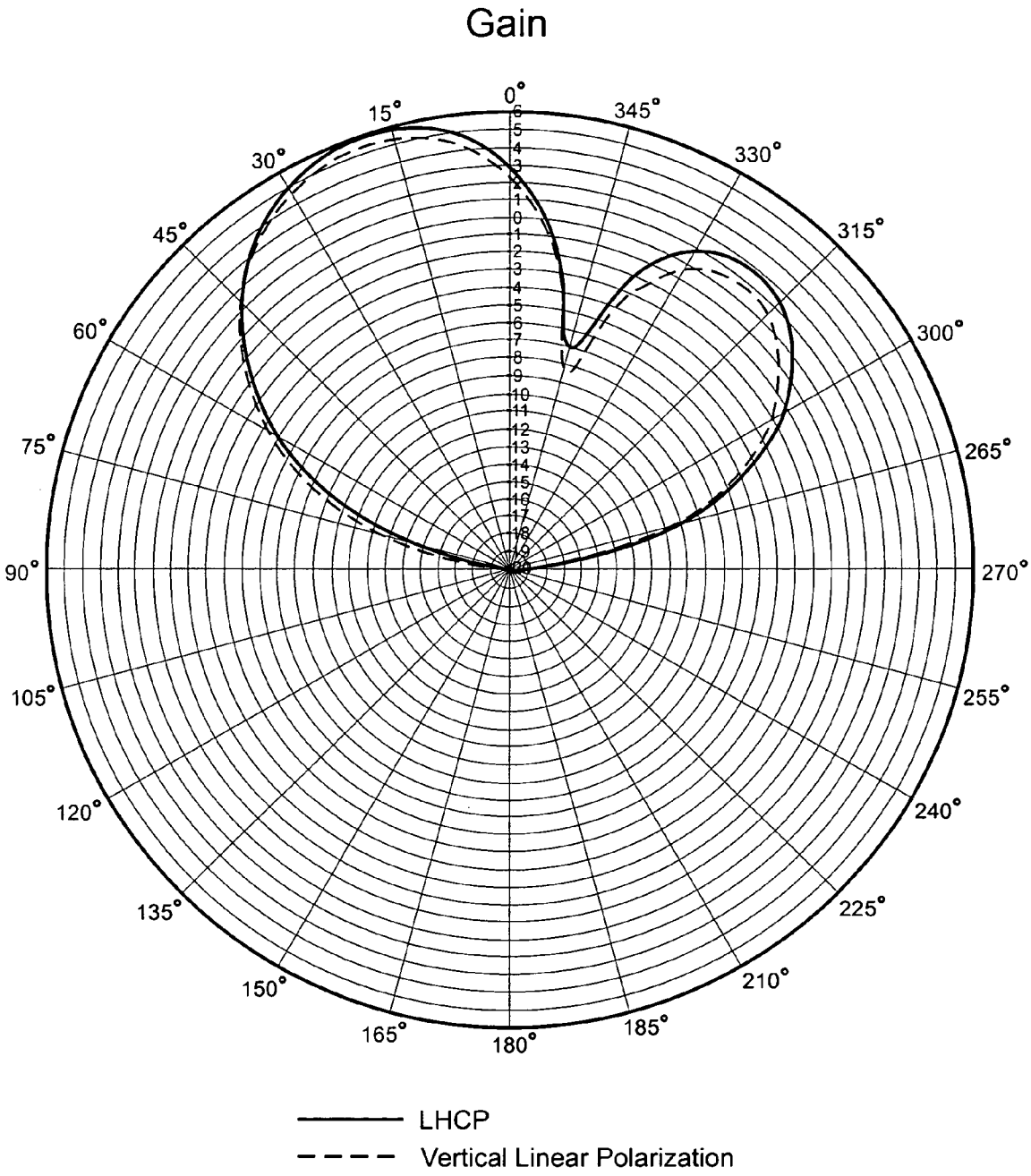
FIG. 7 is a chart showing a radiation pattern produced by the first embodiment of the antenna.

The tilt of the radiation beam is perhaps best understood by reviewing results of a computerized simulation of the antenna 10 of the first embodiment. FIG. 7 shows the LHCP and vertically linearly polarized radiation beams of the subject invention. The highest gain portion of the radiation beams are tilted by about 20°. Conventional non-beam steering antennas provide no such tilt, having their highest gain portion at about 0°. As such, the antenna 10 according to the subject invention produces a higher gain for the RF signal received from the satellite at relatively low elevation angles than conventional non-beam steering antennas.

Multiple antennas 10 may be implemented as part of a diversity system of antennas 10. For instance, the vehicle 14 of the first embodiment may include a first antenna 10 on the windshield and a second antenna 10 on the backlite. These antennas 10 would each have separate amplifiers 52 that are electrically connected to the receiver within the vehicle 14. Those skilled in the art realize several processing techniques may be used to achieve diversity reception. In one such technique, a switch is used to select the antenna 10 that is currently receiving the strongest RF signal from the satellites or terrestrial source.

Obviously, many modifications and variations of the present invention are possible in light of the above teachings. The invention may be practiced otherwise than as specifically described within the scope of the appended claims.

What is claimed is:

1. A window having an integrated antenna, said window comprising:

a nonconductive pane;

a circularly polarized radiation element disposed on said nonconductive pane;

a linearly polarized radiation element having a geometric shape different from that of said circularly polarized radiation element, disposed on said nonconductive pane, and spaced from said circularly polarized radiation element such that a radiation beam produced by said antenna is tilted; and a phase shift circuit electrically connected to said linearly polarized radiation element for phase shifting a base signal, having a phase angle $\beta$, by a certain angle $\Delta\beta$ to achieve a phase-shifted signal having a phase angle $\beta+\Delta\beta$.

2. A window as set forth in claim 1 wherein said radiation elements are co-planar with each other.

3. A window as set forth in claim 1 wherein a surface area of said linearly polarized radiation element is less than a surface area of said circularly polarized radiation element.

4. A window as set forth in claim 1 wherein said linearly polarized radiation element is spaced from said circularly polarized radiation element in a range of 1/20 to 1/2 of a wavelength λ of a base signal to be received or transmitted by said antenna.

5. A window as set forth in claim 4 wherein said linearly polarized radiation element is spaced from said circularly polarized radiation element by about 1/5 of the wavelength λ.

6. A window as set forth in claim 1 further comprising a base signal line electrically connected to said circularly polarized radiation element and carrying said base signal having said phase angle β.

7. A window as set forth in claim 6 further comprising a phase-shifted signal line electrically connected to said linearly polarized radiation element and carrying said phase-shifted signal having said phase angle βΔβ.

8. A window as set forth in claim 7 further comprising a 90°-shifted signal line electrically connected to said circularly polarized radiation element and carrying a 90°-shifted signal having a phase angle β+90°.

9. A window as set forth in claim 8 further comprising a 90° hybrid electrically connected to said base signal line and said 90°-shifted signal line for phase shifting said base signal by 90° to achieve said 90°-shifted signal.

10. A window as set forth in claim 9 further comprising a ground plane spaced from and parallel to said radiation elements and having a first side and a second side.

11. A window as set forth in claim 10 further comprising a dielectric sandwiched between said first side of said ground plane and said radiation elements.

12. A window as set forth in claim 10 further comprising a circuit board connected to said second side of said ground plane.

13. A window as set forth in claim 12 wherein said signal lines, said 90° hybrid, and said phase shift circuit are disposed on said circuit board.

14. A window as set forth in claim 13 further comprising a plurality of pins disposed between said radiation elements and said circuit board electrically connecting said signal lines to said radiation elements.

15. A window as set forth in claim 12 further comprising an amplifier disposed on said circuit board and electrically connected to said base signal line for amplifying said base signal.

16. A window as set forth in claim 1 further comprising a ground plane spaced from and parallel to said radiation elements.

17. A window as set forth in claim 16 further comprising a dielectric sandwiched between said ground plane and said radiation elements.

18. A window as set forth in claim 17 wherein said dielectric is air.

19. A window as set forth in claim 1 wherein said circularly polarized radiation element has a rectangular shape with a first edge and a second edge perpendicular to said first edge.

20. A window as set forth in claim 19 wherein each edge of said circularly polarized radiation element measures about 1/2 of a wavelength λ of a base signal to be received or transmitted by said antenna.

21. A window as set forth in claim 1 wherein said linearly polarized radiation element has a rectangular shape with a third edge and a fourth edge perpendicular to said third edge.

22. A window as set forth in claim 21 wherein said third edge of said linearly polarized radiation element measures about 1/20 of a wavelength λ of a base signal to be received or transmitted by said antenna and said fourth edge of said linearly polarized radiation element measures about 1/2 of the wavelength λ.

23. A window as set forth in claim 21 wherein said third edge of said linearly polarized radiation element measures about 1/20 of a wavelength λ of a base signal to be received or transmitted by said antenna and said fourth edge of said linearly polarized radiation element measures about 1/4 of the wavelength λ.

24. A window as set forth in claim 21 wherein said linearly polarized radiation element defines a slot having a length that measures about 1/2 of a wavelength λ of a base signal to be received or transmitted by said antenna.

25. A window as set forth in claim 1 wherein said nonconductive pane is further defined as a pane of glass.

26. A window as set forth in claim 25 wherein said pane of glass is further defined as automotive glass.

27. A window as set forth in claim 26 wherein said automotive glass is further defined as soda-lime-silica glass.

28. A window as set forth in claim 1 wherein said circularly polarized radiation element is formed of a single patch of electrically conductive material.

29. An antenna comprising:

a circularly polarized radiation element;

a linearly polarized radiation element spaced from said circularly polarized radiation element and having a geometric shape different from that of said circularly polarized radiation element; and a phase shift circuit electrically connected to said linearly polarized radiation element for phase shifting a base signal, having a phase angle β, by a certain angle Δβ to achieve a phase-shifted signal having a phase angle β+Δβ.

30. An antenna as set forth in claim 29 wherein said radiation elements are co-planar with each other.

31. An antenna comprising:

a circularly polarized radiation element;

a linearly polarized radiation element having a geometric shape different from that of said circularly polarized radiation element and spaced from said circularly polarized radiation element such that a radiation beam produced by said antenna is tilted; and a phase shift circuit electrically connected to said linearly polarized radiation element for phase shifting a base signal, having a phase angle β, by a certain angle Δβ to achieve a phase-shifted signal having a phase angle β+Δβ.

32. An antenna as set forth in claim 31 wherein said radiation elements are co-planar with each other.

33. An antenna as set forth in claim 31 wherein said linearly polarized radiation element is spaced from said circularly polarized radiation element in a range of 1/20 to 1/2 of a wavelength λ of a base signal to be received or transmitted by said antenna.

34. A window as set forth in claim 31 wherein said circularly polarized radiation element is formed of a single patch of electrically conductive material.

35. A window having an integrated antenna, said window comprising:

a nonconductive pane;

a circularly polarized radiation element disposed on said nonconductive pane;

a linearly polarized radiation element having a geometric shape different from that of said circularly polarized radiation element, disposed on said nonconductive pane, and spaced from said circularly polarized radiation element such that a radiation beam produced by said antenna is tilted;

a base signal line electrically connected to said circularly polarized radiation element and carrying a base signal having a phase angle $\beta$; and a phase-shifted signal line electrically connected to said linearly polarized radiation element and carrying a phase-shifted signal having a phase angle $\beta+\Delta\beta$.

* * * * *

UNITED STATES PATENT AND TRADEMARK OFFICE

CERTIFICATE OF CORRECTION

PATENT NO. : 7,224,319 B2
APPLICATION NO. : 11/031660
DATED : May 29, 2007
INVENTOR(S) : Sundus Kubba et al.

It is certified that error appears in the above-identified patent and that said Letters Patent is hereby corrected as shown below:

Column 9, line 16, between symbols "β and Δ" insert -- + --.

Signed and Sealed this

Thirty-first Day of July, 2007

JON W. DUDAS
*Director of the United States Patent and Trademark Office*